US008245639B2

(12) United States Patent
Katsuda et al.

(10) Patent No.: US 8,245,639 B2
(45) Date of Patent: Aug. 21, 2012

(54) IGNITER FIXING STRUCTURE

(75) Inventors: Nobuyuki Katsuda, Hyogo (JP); Mikio Yabuta, Hyogo (JP)

(73) Assignee: Daicel Chemical Industries, Ltd., Osaka-shi (JP)

( * ) Notice: Subject to any disclaimer, the term of this patent is extended or adjusted under 35 U.S.C. 154(b) by 35 days.

(21) Appl. No.: 12/731,672

(22) Filed: Mar. 25, 2010

(65) Prior Publication Data

US 2010/0242779 A1 Sep. 30, 2010

Related U.S. Application Data

(60) Provisional application No. 61/164,228, filed on Mar. 27, 2009.

(30) Foreign Application Priority Data

Mar. 26, 2009 (JP) ..... 2009-75512

(51) Int. Cl.
*F42B 3/103* (2006.01)
*C06D 5/00* (2006.01)

(52) U.S. Cl. ..... 102/202.14; 102/202.9; 102/530

(58) Field of Classification Search ..... 102/200, 102/202.9, 202.14, 202.12, 530, 531, 202.7; 280/740, 741, 736
See application file for complete search history.

(56) References Cited

U.S. PATENT DOCUMENTS

| | | | | |
|---|---|---|---|---|
| 6,019,389 | A * | 2/2000 | Burgi et al. | 280/736 |
| 6,412,815 | B1 * | 7/2002 | Nakashima et al. | 280/736 |
| 6,491,320 | B1 * | 12/2002 | Nakashima et al. | 280/736 |
| 6,763,764 | B2 | 7/2004 | Avetisian et al. | |
| 6,820,556 | B1 | 11/2004 | Oda | |
| 7,347,448 | B2 * | 3/2008 | Smith et al. | 280/736 |

FOREIGN PATENT DOCUMENTS

JP 2003-161599 A 6/2003

* cited by examiner

*Primary Examiner* — James Bergin
(74) *Attorney, Agent, or Firm* — Birch, Stewart, Kolasch & Birch LLP

(57) ABSTRACT

An igniter fixing structure includes a plurality of igniter bodies having an ignition portion and an electroconductive pin, each of the igniter bodies being fixed, by a resin, to a peripheral edge of a port formed in a plate-like portion serving as a fixing object, the number of the port being the same as that of the plurality of the igniter bodies, and a single retainer as a support member for the plurality of igniter bodies.
The retainer has a plurality of support portions each having a hole for passing the electroconductive pin therethrough and a connection plate portion that connects the plurality of support portions, at least the support portions are embedded in the resin in a state in which the electroconductive pin passes through the hole, and at least the connection plate portion is disposed to abut against the plate-like portion.

10 Claims, 3 Drawing Sheets

IGNITER FIXING STRUCTURE

This nonprovisional application claims priority under 35 U.S.C. §119(a) to Patent Application No. 2009-075512 filed in Japan on 26 Mar. 2009 and under 35 U.S.C. §119(e) to U.S. Provisional Application No. 61/164,228 filed on 27 Mar. 2009, both of which are incorporated by reference.

BACKGROUND OF THE INVENTION

1. Field of Invention

The present invention relates to an electric igniter fixing structure suitable for a gas generator for use in a restraining device and to a gas generator using the igniter fixing structure.

2. Description of Related Art

In an electric igniter, an electroconductive pin through which an actuation current flows is mounted on a base portion called a header, and then a cup is fixed to the header. An ignition agent is accommodated inside the cup in contact with a bridge wire, and the bridge wire is heated by an ignition current to ignite the ignition agent. A structure is known in which when an igniter is mounted on and fixed to a housing or the like of a gas generator for an airbag, a resin is injected to the igniter and a single fixing member so as to integrate the igniter with the fixing member by the resin.

U.S. Pat. No. 6,763,764 discloses a system 2 using two igniters. In particular, in FIG. 2, a retainer 6 having a unitary structure 20 is deformed with a press or the like, and two igniters 4 are integrated by a molded body 8 with the retainer 6. The molded body 8 is in the form of a lump and the two igniters 4 are fixed thereby to the retainer 6.

SUMMARY OF THE INVENTION

The present invention provides an igniter fixing structure, including a plurality of igniter bodies, each having an ignition portion and an electroconductive pin, each of the igniter bodies being fixed, by a resin, to a peripheral edge of a port formed in a plate-like portion serving as a fixing object, the number of the port being the same as that of the plurality of the igniter bodies, and a single retainer as a support member for the plurality of igniter bodies, the retainer having a plurality of support portions each having a hole for passing the electroconductive pin therethrough and a connection plate portion that connects the plurality of support portions, at least the support portions being embedded in the resin in a state in which the electroconductive pin passes through the hole, at least the connection plate portion being disposed to abut against the plate-like portion.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 1:
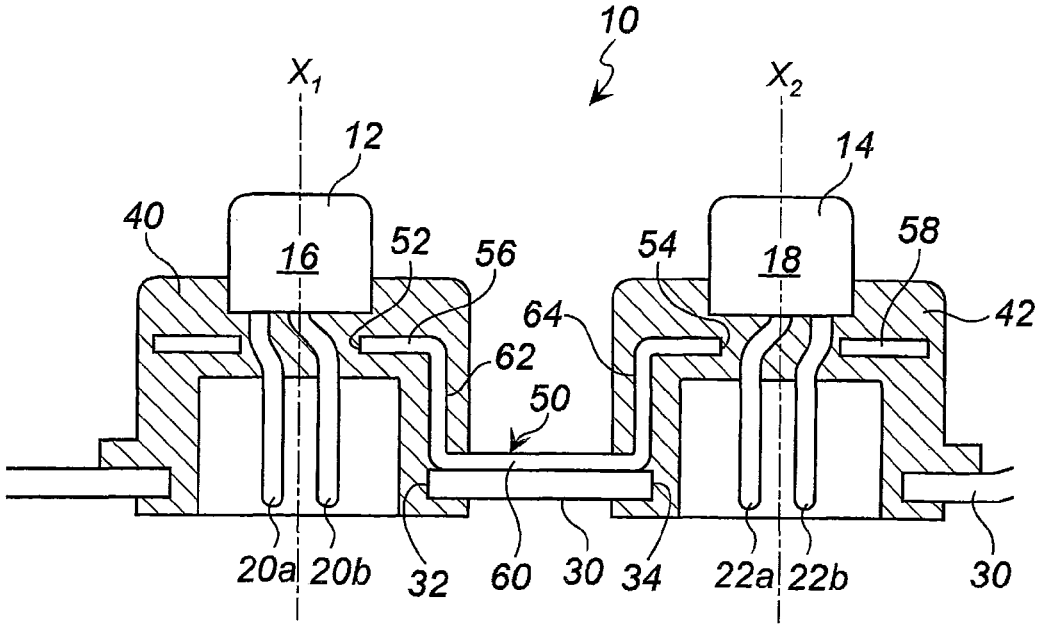
FIG. 1 shows a cross-sectional view of an igniter fixing structure in accordance with the present invention.

In the fixing structure described in U.S. Pat. No. 6,763,764, the retainer 6 has many portions that are not embedded in the resin and the contact surface area of the retainer 6 and the base 16 is small, or there is no contact therebetween at all. As a result, when the igniter is actuated, a support strength demonstrated when a force is applied from above to the igniter is insufficient.

The present invention provides an igniter fixing structure with increased fixing strength of the igniter and also a gas generator using the igniter fixing structure.

In the case of a gas generator used in an airbag apparatus, the plate-like portion serving as the fixing object is, for example, a bottom plate of a housing.

The support portions and the connection plate portion of the retainer may be in the same plane, or the support portions and the connection plate portion may be integrated by wall portions formed of vertical surfaces, stepped surfaces, or inclined surfaces. These vertical surfaces, stepped surfaces, or inclined surfaces may be curved surfaces protruding in one direction or flat surfaces.

In the retainer, each of the support portions is embedded in the resin and part of the connection plate portion may be also embedded in the resin. Further, when a wall portion including a vertical surface, a stepped surface, or an inclined surface is provided between the support portions and the connection plate portion, the entire wall portion or part thereof is preferably embedded in the resin. With such an embedded structure, the support strength of the igniter bodies can be further increased.

The entire connection plate portion of the retainer or part thereof and the plate-like portion serving as the fixing object are in mutual contact by surfaces thereof. Such a contact state makes it possible to increase further the support strength of the igniter bodies.

Each of the plurality of support portions may have hole through which the electroconductive pins can be passed. For example, each of the support portions may have an annular shape having a hole. A shape in which part of the above mentioned annular shape is cut out or a shape in which a hole is provided in part of a disk may be also used. The hole diameter in each of the plurality of support portions is less than the outer diameter of the ignition portion of the igniter body.

The hole of the support portion has a size such that the electroconductive pin can pass therethrough, but such that the ignition portion cannot pass therethrough. Therefore, even when the resin strength decreases under the effect of heat, impact, or pressure generated when the igniter is actuated, the igniter body is prevented from falling out from the retainer or the plate-like portion as a fixing object. The hole may be not only of a round shape, but also of a polygon shape or elliptical shape, provided that the size thereof is such that the ignition portion cannot pass therethrough.

The entire retainer can be embedded in the resin. With such a structure, the plurality of igniter bodies and the retainer can be fixed by a single step in resin injection. Therefore, the production process is simplified.

The present invention provides a gas generator, having a gas generating agent as a gas generation source, the gas generator using the above-described igniter fixing structure, wherein the plate-like portion serving as the fixing object is a housing bottom plate of the gas generator.

By applying the igniter fixing structure in accordance with the present invention to the conventional gas generator having an electric igniter, it is possible to simplify the fixing method and also increase the fixing strength.

With the igniter fixing structure in accordance with the present invention, the support strength of igniter bodies is increased by the disposing state and attachment state of the retainer. Therefore, even when heat or pressure is applied during actuation, the fixing state of the igniter bodies is not affected thereby.

The igniter fixing structure in accordance with the present invention can be applied to a gas generator for use in an airbag system and a seatbelt pretensioner in order to protect a vehicle occupant, or an airbag for a pedestrian protection that is attached outside the vehicle, and also can be applied to actuators for use in impact-absorbing steering and current cut-off devices.

Embodiments of the Invention

<Fixing Structure of Igniter Shown in FIG. 1>

Figure 2:
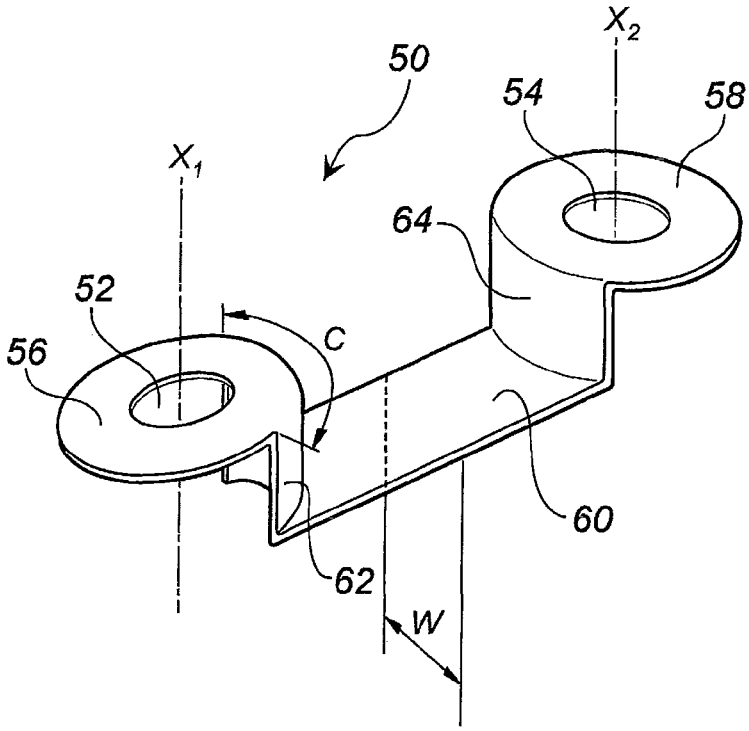
FIG. 2 shows a perspective view of a retainer used in the structure shown in FIG. 1.

An embodiment of the present invention will be described below with reference to FIG. 1 and FIG. 2. FIG. 1 is a cross-sectional view illustrating an igniter fixing structure 10 in accordance with the present invention. FIG. 2 is a perspective view of a retainer shown in FIG. 1. The shapes of a retainer 50 and a plate-like portion 30 shown in FIG. 1 are not limited to those shown in the drawing.

Two electric igniters (a first igniter 12 and a second igniter 14) are known igniters in which a first ignition portion 16 and a second ignition potion 18 are filled with an ignition agent, and that two electroconductive pins 20*a*, 20*b* and 22*a*, 22*b* extend from the respective ignition portions. The first igniter 12 and the second igniter 14 may have identical or different shapes, dimensions, and outputs.

A plate-like portion 30 onto which the first igniter 12 and the second igniter 14 are mounted is, for example, a bottom of the housing in the conventional gas generator and has two ports (a first port 32 and a second port 34) formed side by side therein. The portion where the first port 32 and second port 34 are formed is flat, and other portions may be deformed, for example, in the form of concavities and convexities or inclined portions.

The central axes $X_1$, $X_2$ of the first port 32 and the second port 34 coincide with the central axes of the first igniter 12 and second igniter 14, respectively. The distance between the axes $X_1$ and $X_2$ may be 10 mm to 35 mm, preferably 15 mm to 25 mm.

The first igniter 12 is fixed together with the retainer 50 by a resin 40 to the plate-like portion 30 (a peripheral edge portion of the first port 32), and the electroconductive pins 20*a*, 20*b* are led through the first port 32. A space where the electroconductive pins 20*a*, 20*b* are exposed and protrude is a connector insertion portion.

The second igniter 14 is fixed together with the retainer 50 by a resin 42 to the plate-like portion 30 (a peripheral edge portion of the second port 34), and the electroconductive pins 22*a*, 22*b* are led through the second port 34. A space where the electroconductive pins 22*a*, 22*b* are exposed and protrude is a connector insertion portion. The resin 40 and resin 42 are not linked together.

A resin, for example, such as disclosed in JP-A No. 2003-161599 can be used as the resins 40 and 42.

The retainer 50 has a shape shown in FIG. 2 and includes a first annular support portion 56 having a first hole 52, a second annular support portion 58 having a second hole 54, and a connection plate portion 60. Further, the first annular support portion 56 and one end of the connection plate portion 60 are connected by a first wall surface portion 62, and the second annular support portion 58 and the other end of the connection plate portion 60 are connected by a second wall surface portion 64.

The first wall surface portion 62 and the second wall surface portion 64 have a curved shape that extends vertically as shown in the drawing and include circular arcs C corresponding to a width W of the connection plate portion 60, but these wall surface portions may also be flat or in the form of stepped or inclined surface.

The central axes of the first hole 52 and the second hole 54 coincide respectively with the axes $X_1$ and $X_2$ that are shown in FIG. 1. In the retainer 50, the first annular support portion 56 and the second annular support portion 58 have the same size, and the first hole 52 and the second hole 54 also have the same size, but the sizes may differ depending on the size of the igniters 12, 14. The inner diameters of the first hole 52 and the second hole 54 are smaller than the outer diameters of the first ignition portion 16 and the second ignition portion 18, respectively.

In the retainer 50, the first annular support portion 56, the first wall surface portion 62, and one end of the connection plate portion 60 are embedded in the resin 40 (are in the embedded state and are not exposed), and the second annular support portion 58, the second wall surface portion 64, and the other end of the connection plate portion 60 are embedded in the resin 42 (are in the embedded state and are not exposed). A large portion of the connection plate portion 60, including the central portion thereof, is not covered by the resins 40, 42 and is in surface contact with the plate-like portion 30. In this case, no resin is present on the contact surface of the connection plate portion 60 and the plate-like portion 30.

With the igniter fixing structure 10 shown in FIG. 1, when the first igniter 12 and the second igniter 14 are actuated, the resins 40, 42 are melted by the impacts or heat thereof, and even when a load acts upon the first igniter 12 and second igniter 14, the first ignition portion 16 and the second ignition portion 18 are prevented from falling off due to the presence of the first annular support portion 56 (the first hole 52) and the second annular support portion 58 (the second hole 54).

Further, as shown in FIG. 1, the retainer 50 meets the following requirements:

(i) the entire first annular support portion 56 and the entire first wall surface portion 62 and one end portion of the connection plate portion 60 are embedded in the resin 40;

(ii) the entire second annular support portion 58 and the entire second wall surface portion 64 and the other end portion of the connection plate portion 60 are embedded in the resin 42;

(iii) the connection plate portion 60 is in a state of contact with the plate-like portion 30 that has not been embedded in the resin.

By meeting the above requirements, even when a force is produced to apply pressure vertically downward, as shown in FIG. 1, to the first igniter 12 and the second igniter 14 during actuation, a support action for the igniters can be demonstrated that ensures sufficient resistance to this force.

Figure 3:
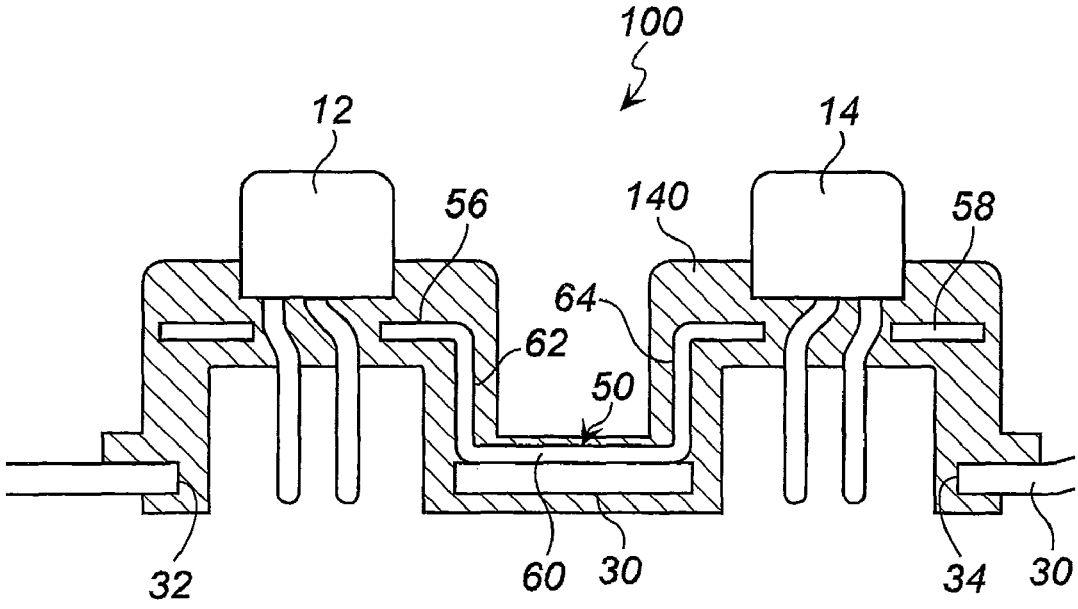
FIG. 3 shows a cross-sectional view of another embodiment of the igniter fixing structure in accordance with the present invention.

<Fixing Structure of Igniter Shown in FIG. 3>

FIG. 3 shows another embodiment of the igniter fixing structure in accordance with the present invention that uses the retainer shown in FIG. 2. An igniter fixing structure 100 shown in FIG. 3 is basically identical to the structure shown in FIG. 1, but the state in which a first igniter 12, a second igniter 14, and a plate-like portion 30 are fixed by a resin 140 is different. The shape of a retainer 50 and the plate-like portion 30 shown in FIG. 3 are not limited to those shown in the drawing.

The state of arrangement for the first igniter 12, the second igniter 14, the plate-like portion 30, and the retainer 50 in FIG. 3 is identical to that shown in FIG. 1, but the entire retainer 50 is embedded in the resin 140. Further, the plate-like portion 30 that abuts against a connection plate portion 60 of the retainer 50 is also embedded in the resin 140.

In the embodiment shown in FIG. 3, a through hole may be formed in the plate-like portion 30 that abuts against the connection plate portion 60, and this through hole may be also filled with the resin 140.

In the embodiment shown in FIG. 1, two steps of injection molding are necessary to form the resin 40 and the resin 42, but in the embodiment shown in FIG. 3, only single injection molding step is sufficient.

In the fixing structure 100 of the embodiment shown in FIG. 3, the igniter support action, that is ensured by meeting the above-described requirements (i) to (iii), is also demonstrated, but because the connection plate portion 60 and the plate-like portion 30 abutting thereon are also embedded in the resin 140, the igniter support action superior to that of the embodiment shown in FIG. 1 can be demonstrated.

Figure 4:
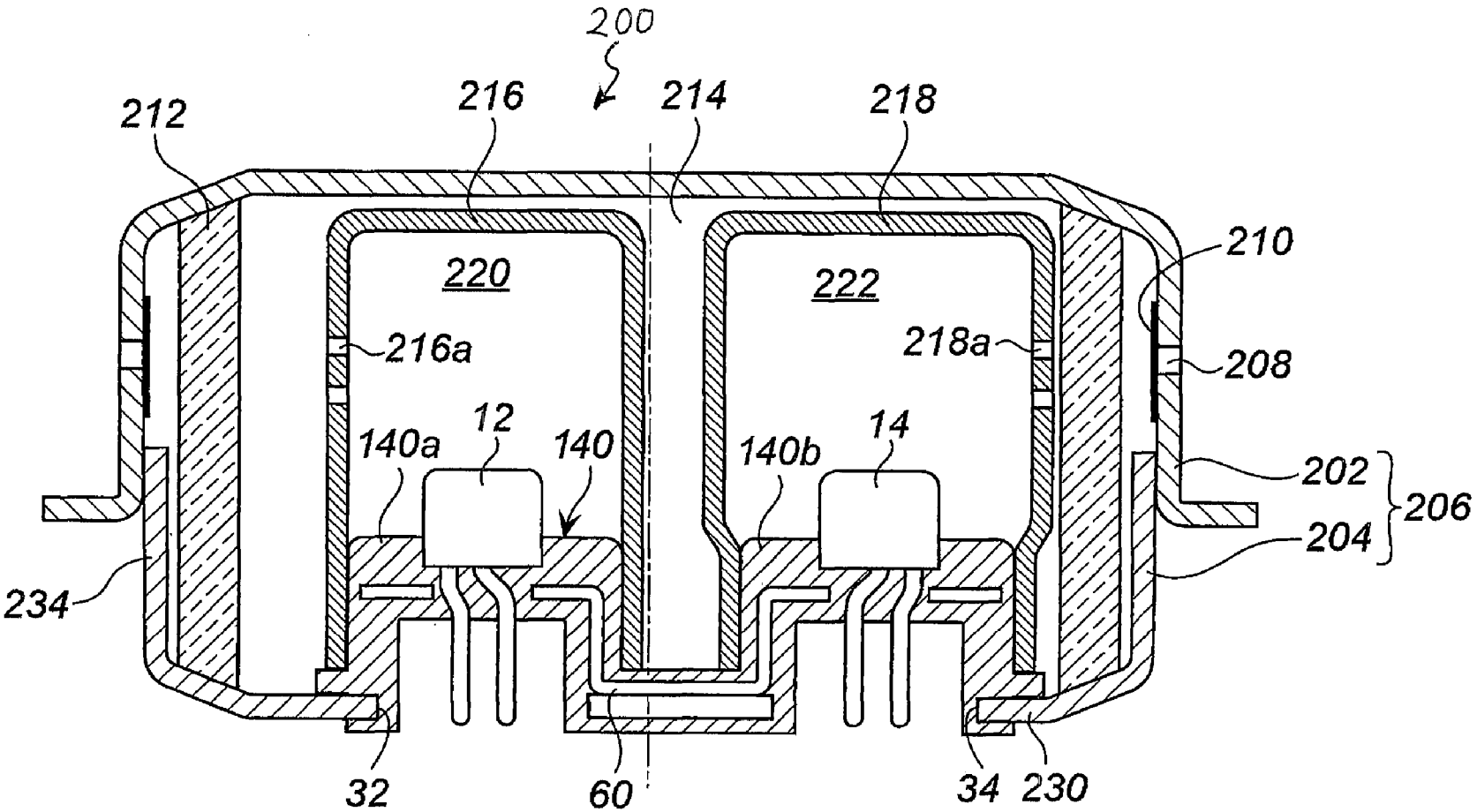
FIG. 4 shows a cross-sectional view of a gas generator using the igniter fixing structure in accordance with the present invention.

<Gas Generator Shown in FIG. 4>

FIG. 4 is a cross-sectional view in the axial direction of a gas generator of an airbag for a restraining device that is installed on a vehicle, this gas generator uses the igniter fixing structure 100 shown in FIG. 3. The shapes of the retainer 50 and a bottom plate 230 shown in FIG. 4 are not limited to those shown in the drawing.

In a gas generator 200, an outer shell is formed by a housing 206 that is obtained by welding together a diffuser shell 202 and a closure shell 204. A plurality of gas discharge ports 208 are provided in the circumferential surface of the diffuser shell 202 and closed from the inside by a sealing tape 210 made of aluminum. The bottom plate 230 of the closure shell 204 corresponds to the plate-like portion as the fixing object.

The first igniter 12 and the second igniter 14 are attached integrally with the retainer 50 to the closure shell 204 by the resin 140. The attachment and arrangement of the bottom plate 230, the igniters 12, 14, the resin 140 and the retainer 50 are identical to those of the embodiment shown in FIG. 3.

A cylindrical filter 212 is disposed inside the housing 206, and an annular gap is formed between the outer circumferential surface of the filter 212 and the gas discharge ports 208, the sealing tape 210, and a circumferential wall portion 234.

A first combustion chamber 214 is formed inside the filter 212 and filled with a first gas generating agent (known gas generating agent) that is not shown in the drawing. An ignition chamber cup member 216 and a combustion chamber cup member 218 are disposed adjacently to each other inside the first combustion chamber 214.

The opening of the ignition chamber cup member 216 is fitted onto the resin 140. The inside of the ignition chamber cup member 216 serves as an enhancer chamber 220 and is filled with a gas generating agent (known gas generating agent) that is not shown in the drawing. A communication hole 216*a* is formed in the circumferential wall portion and closed with a sealing tape or the like prior to actuation.

A combustion chamber cup member 218 is fitted from the opening side onto the resin 140. A plurality of communication holes 218*a* are formed in the circumferential wall surface and closed with a sealing tape from the outside prior to actuation. The inside of the combustion chamber cup member 218 serves as a second combustion chamber 222 and filled with a second gas generating agent (known gas generating agent) that is not shown in the drawing.

The operation of the gas generator 200 shown in FIG. 4 will be explained below. The first igniter 12 and the second igniter 14 can be actuated in the following modes correspondingly to the degree of impact received by the automobile at the time of collision: only the first igniter 12 is actuated, initially the first igniter 12 is actuated and then the second igniter 14 is actuated with a certain delay, and the first igniter 12 and the second igniter 14 are actuated at the same time. However, only a case in which initially the first igniter 12 is actuated and then the second igniter 14 is actuated with a certain delay will be described below.

When the automobile collides and receives the impact, an actuation signal is received from a control unit, the first igniter 12 is actuated and ignited, and the gas generating agent located inside the enhancer chamber 220 is ignited and burned. The combustion products (high-temperature gas and flame) enter the first combustion chamber 214 through the communication holes 216*a* and cause ignition and combustion of the first gas generating agent to generate a combustion gas. The combustion gas is filtered and cooled by passing through the filter 212 and then ruptures the sealing tape 210 and is discharged from the gas discharge port 208 and inflates the airbag. In this case, because the communication holes 218*a* are closed with the sealing tape (not shown in the drawing) from the outside, the second gas generating agent located inside the second combustion chamber 222 is not ignited or burned by the combustion gas generated by combustion of the first gas generating agent.

The second igniter 14 is actuated and ignited with a certain delay after the ignition of the first igniter 12, the second gas generating agent located inside the second combustion chamber 222 is ignited and burned, and a combustion gas is generated. This combustion gas ruptures the sealing tape (not shown in the drawing) of the communication holes 218*a* and flows out from the communication holes 218*a* into the first combustion 214. Then, the combustion gas is filtered and cooled by passing through the filter 212 and introduced into the airbag from the gas discharge port 208.

Both the first igniter 12 and the second igniter 14 are exposed to high-temperature combustion gases due to combustion of the first gas generating agent located inside the enhancer chamber 220 and the second gas generating agent located inside the second combustion chamber 222 as a result of the actuation of the respective igniters. Therefore, the resin 140 (the resin 140*a* on the side of the first igniter 12 and the resin 140*b* on the side of the second igniter 14) is also affected by the temperature and pressure of the combustion gases.

In such a state at a high temperature and under a high pressure, a downward force is applied to the first igniter 12 and the second igniter 14 (force in the direction of the bottom plate 230), and if the support strength of the resin 140 is insufficient, the first igniter 12 and the second igniter 14 can fall out to the outside of the housing 206.

However, because the igniter fixing structure 100 is used and the igniter support action, provided by meeting the above-described requirements (i) to (iii), is demonstrated, the first igniter 12 and second igniter 14 are prevented from falling out to the outside of the housing 206.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An igniter fixing structure, comprising:

a plurality of igniter bodies, having an ignition portion and an electroconductive pin, each of the igniter bodies being fixed, by a resin, to a peripheral edge of a port formed in a plate-like portion serving as a fixing object, the number of the port being the same as that of the plurality of the igniter bodies; and a single retainer as a support member for the plurality of igniter bodies, the retainer having a plurality of support portions each having a hole for passing the electroconductive pin therethrough and a connection plate portion that connects the plurality of support portions, at least the support portions being embedded in the resin in a state in which the electroconductive pin pass through the hole, at least the connection plate portion being disposed to abut against the plate-like portion, wherein both ends of the retainer are completely embedded in the resin and do not make contact with the plate-like portion.

2. The igniter fixing structure according to claim 1, wherein each of the plurality of support portions and the connection plate portion of the retainer are integrated by wall portions formed of a vertical surface, a stepped surface or an inclined surface.

3. The igniter fixing structure according to claim 2, wherein each of the wall portions is a vertical surface that extends in a vertical direction and has a shape of a circular arc corresponding to a width of the connecting place portion.

4. The igniter fixing structure according to claim 2, wherein the wall portions are completely embedded in the resin.

5. The igniter fixing structure according to claim 2, wherein an upper surface of the connection plate portion is embedded in the resin.

6. The igniter fixing structure according to claim 1, wherein a hole diameter of the plurality of support portions is less than an outer diameter of the ignition portion of the igniter body.

7. The igniter fixing structure according to claim 1, wherein the entire retainer is embedded in the resin.

8. A gas generator, having a gas generating agent as a gas generation source, including the igniter fixing structure according to claim 1, wherein the plate-like portion serving as the fixing object is a housing bottom plate of the gas generator.

9. The gas generator according to claim 8, wherein a bottom surface of the housing bottom plate at a portion corresponding to the connection plate portion is entirely covered by the resin.

10. The igniter fixing structure according to claim 1, wherein an entire bottom surface of the connection plate portion is configured to make contact with an upper surface of the plate-like portion.

* * * * *